United States Patent [19]

Beveridge

[11] 4,146,149

[45] Mar. 27, 1979

[54] CONTAINER CLOSURE WITH VENT MEANS

[75] Inventor: John Beveridge, Woodcote, England

[73] Assignee: Metal Box Limited, Reading, England

[21] Appl. No.: 890,214

[22] Filed: Mar. 27, 1978

[51] Int. Cl.[2] ..... B65D 41/32

[52] U.S. Cl. ..... 220/271

[58] Field of Search ..... 220/270, 271, 256–258

[56] References Cited

U.S. PATENT DOCUMENTS

| | | | |
|---|---|---|---|
| 3,401,820 | 9/1968 | Taylor | 220/271 |
| 3,445,027 | 5/1969 | Palmer | 220/270 |
| 3,951,299 | 4/1976 | Khoury | 220/271 X |
| 4,044,916 | 8/1977 | Beveridge | 220/270 |

*Primary Examiner*—George T. Hall

*Attorney, Agent, or Firm*—Charles E. Brown

[57] ABSTRACT

An easy opening end unit particularly adapted for packaging granular material such as coffee under pressure and wherein the initial opening of the end unit is by way of a vent opening. The vent opening has underlying the same a baffle plate or diaphragm which is formed of impermeable material and is bonded to the underside of the end unit.

10 Claims, 5 Drawing Figures

CONTAINER CLOSURE WITH VENT MEANS

This invention relates to end closures for containers for powders and more particularly, but not exclusively, to the venting of coffee cans closed with a tear open can end.

When freshly roast coffee beans are ground and packed into cans, the vapours and aroma given off by the ground coffee can generate considerable pressure within the can after it is closed. Over a day or two this pressure can rise as high as 14 psi.

When a can under such pressure is opened gradually by means of a key or tear tab, the pressure is sufficient to force some of the coffee out of the initial opening causing spillage.

A coffee can is known having a full aperture tear open end of the kind comprising a removable disc portion defined by a circular score. A pull tab is fixed to the removable disc by means of a rivet at the centre of the disc. A starting score line extends around the rivet, one end of the line leading in a generally radial direction to connect with the circular score; so that the user first lifts the tab to break the starting score line and then tears progressively along the starting score to the circular score. Further tearing along the circular score removes the torn disc from the can. However, during the initial lifting of the tab, when the opening is small, high pressure within the can caused coffee to spurt out. To remedy this, a disc of porous paper was attached to the inside of the can end so that it spanned the area of initial opening around the rivet, and acted as a sieve to permit venting and prevent coffee emerging. The porous paper was somewhat fragile and therefore assembly to the can end was difficult.

This invention provides a tear open can end having openable portion defined by a line of weakness, a pull tab attached to the openable portion, and a diaphragm of impermeable material locally attached to the reverse side of the end to overlie the line of weakness at that part of the line of weakness which is first opened when the full tab is used to open the openable portion from the can end.

In one embodiment the invention provides a tear open can end of a kind having a removable portion defined by a first score line, a pull tab attached by a rivet to overlie the removable portion, and a second score line extending part way around the rivet on a path radially inwards thereof to permit lifting of the pull tab to open the second score line without rupturing the first score line, wherein a baffle plate or diaphragm of impermeable material attached locally to the reverse side of the removable portion spans that portion of the second score line which is first opened when the tap is lifted. The diaphragm preferably spans substantially the whole removable portion.

The diaphragm is of a flexible material such as aluminium foil or thin plastic sheet, attached to the can end by an adhesive.

In a preferred embodiment the diaphragm is a laminate of aluminium foil and a terpolymer of acrylic acid, acrylic ester and a cation, the reverse side of the can end is coated with an epoxy resin and the terpolymer is heat sealed to the coating to attach the diaphragm to the openable portion.

In a second aspect this invention provides a can fitted with a tear open can end according to the first aspect.

Various embodiments will now be described by way of example and with reference to the accompanying drawings in which.

Figure 1:
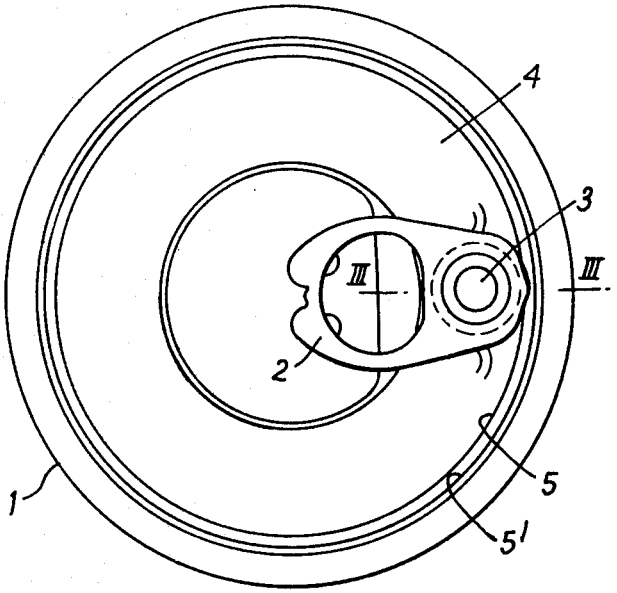
FIG. 1 is a plan view of the outside of a known tear open can end.

FIG. 1 shows the outside of a round tear tab easy opening can end 1 comprising a rigid pull tab 2 fixed, by means of a hollow rivet 3 integral with a removable portion 4 defined by a circular first score line 5. An auxiliary circular score line $5^1$ surrounds the first score line 5.

Figure 2:
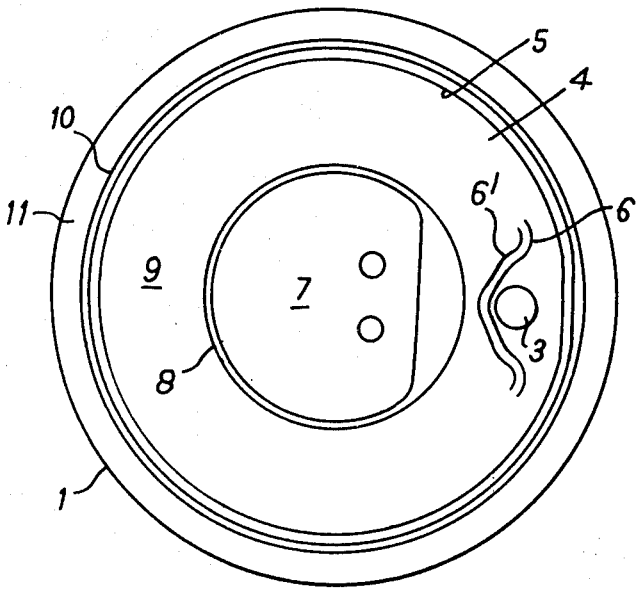
FIG. 2 is a plan view of the reverse surface of the can end of FIG. 1.

FIG. 2 shows the reverse side of the can end of FIG. 1. The reverse side becomes an inside wall of a can when the end is double seamed to a can body. In FIG. 2 a second score line 6 extends along an arcuate path part way around the hollow rivet 3 and thereafter extends towards, but does not join the first score line 5. An auxiliary second score line $6^1$ extends alongside the second score line 6. When the pull tab 2 is raised the second score lines 6, $6^1$ are broken before the first score lines 6, $6^1$.

Referring to FIGS. 1 and 2 the can end can be seen to have a removable portion 4 and an annular portion surrounding it. The removable portion 4 comprises a central panel 7 joined by step portion 8 to an annular panel 9 bounded by the score lines 5, $5^1$. The surrounding annular portion comprises an annular countersink wall 10 which terminates in a peripheral cover hook 11 which is used to attach the can end to a can body by double seaming.

The auxiliary score lines $5^1$ and $6^1$ serve to act as useful lines of weakness in case the primary score lines 6 and 5 fail to tear properly. In known prior art ends the auxiliary score lines are forged to a depth less than the primary score lines to redistribute the internal stress in the can end material. Whilst the auxiliary score lines are useful they are not essential to an understanding of the present invention and are therefore omitted from FIG. 3 for clarity.

Figure 3:
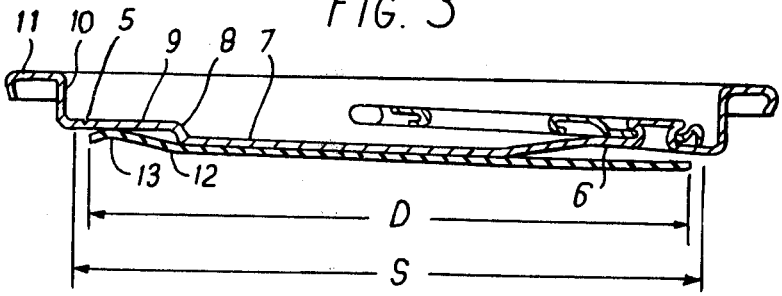
FIG. 3 is a side elevation of a can end according to the invention sectioned in a diameter.
Figure 5:
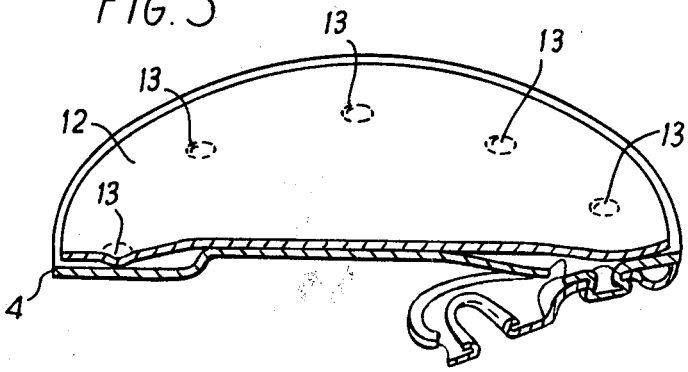
FIG. 5 is a perspective view of the removed portion of the can end of FIG. 3 sectioned on a diameter.

FIG. 3 shows a can end according to the invention in which a circular diaphragm or baffle disc 12 has been attached at a plurality of points 13 to the reverse side of the can end of FIGS. 1 and 2. In FIG. 3 the attachment points 13 are arranged around the annular panel 9, as is best seen in FIG. 5 which shows the removable portion 4 after removal.

Referring again to FIG. 3 it will be seen that the diaphragm 12 has a diameter "D" which is a little smaller than the diameter "S" of the score line 5, so that the diaphragm may be pulled out through the aperture created when score line 5 is torn open by pulling on the pull tab to remove the removable portion 4 from the annular portion of the end.

Figure 4:
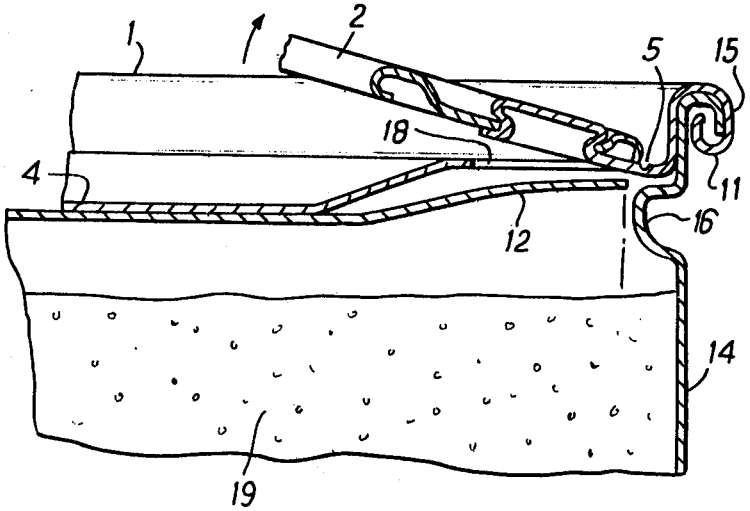
FIG. 4 is a fragmentary view of the tear tab end of FIG. 3 on a can during venting, sectioned on a diameter.

FIG. 4 shows the can end of FIG. 3 attached to the body 14 of a can 1 by engaging the cover hook 11 with a body flange to make a double seam 15. The body wall 14 extends axially downwards from the double seam to an annular guard bead 16 which extends into the can and serves to mask the torn edge portion A arising when the first score line 5 is torn to remove the removable portion 4 from the can end 1. The baffle disc 12 is smaller in diameter than the internal diameter of the guard bead 16 to ensure that the baffle does not become trapped between the bead 16 and the edge portion 17.

In FIG. 4 the can contains coffee under a gaseous pressure and the can end is shown during venting. The rigid pull tab 2 has been raised, in the direction of the arrow, to break the second score line 6 and are at a venting opening without breaking the first score line 5. The baffle disc 12 spans the opening 18 so created and so prevents the coffee 19 being forced directly out of the can but allows the excess pressure to be abated.

After venting, the pull tab 2 is raised still further to pierce the first score line 5 and permit removal of the removable portion 4. FIG. 5 shows the removable portion after removal.

The preferred baffle disc 12 in FIG. 5 is almost as large in diameter as the removable portion 4, and concentric with the portion 4. This facilitates assembly of the baffle discs to the can ends in that there is no need for precise orientation of the discs upon the ends to make sure that the venting portion of the second score line 6 is covered.

However, considerable economies in baffle disc material may be made if the disc is cut to dimensions adequate only to cover the area of initial opening. Such smaller baffle discs require careful location upon the can ends, this being best achieved in the end making press, in which the pull tab is at a known location in relation to the press frame and tools.

The baffle discs are preferably made from a flexible material and may be glued in position by means of known adhesives.

A particularly convenient baffle material is aluminium foil 0.004" thick coated overall with a terpolymer of acrylic acid, acrylic ester and a cation (such a polymer is sold under the trade mark SURLYN). If this material is used, the inside of the can end is coated with an epoxy resin coating and the terpolymer coating is locally heat sealed in spots, to attach the foil to the can end.

Whilst the invention has been described with reference to a full aperture tear open can end having a first score line and a separate second score line, it will be understood that it is not limited thereto. The baffle plate according to the invention may be used instead of the porous barrier, to interrupt the path of gas to that peripheral portion of the score line around the rivet, first opened in the prior art and herein before described. In which case the diaphragm is conveniently a rectangle large enough to cover the rivet and that first opened portion of score line around it. The rectangular diaphragm is attached either by a plurality of heat seals as herein before described or alternately, a single margin of adhesion along one edge of the rectangle will suffice to retain the diaphragm over the openable portion and permit exit of gas across the planar face of the rectangle to the venting aperture created on opening.

What we claim is:

1. A tear open can end of a kind having a removable portion defined by a first score line, a pull tab attached by a rivet to overlie the removable portion, and a second score line extending part way around the rivet on a path radially inwards thereof to permit lifting of the pull tab to open the second score line without rupturing the first score line, wherein a baffle plate or diaphragm of impermeable material attached locally to the reverse side of the removable portion spans that portion of the second score line which is first opened when the tab is lifted, said baffle plate or diaphragm being of a size less than said removable portion for removal therewith in its entirety.

2. A tear open can end according to claim 2 wherein the diaphragm spans the whole removable portion.

3. A tear open can end according to claim 1 wherein the diaphragm is of a flexible material attached to the can end by an adhesive.

4. A tear open can end according to claim 1 wherein the diaphragm is aluminium foil.

5. A tear open can end according to claim 4 wherein the diaphragm is a laminate of said aluminium foil and a terpolymer of acrylic acid, acrylic ester and a cation, the reverse side of the can end is coated with an epoxy resin and the terpolymer is heat sealed to the coating to attach the diaphragm to the openable portion.

6. A tear open can end according to claim 1 when fitted to a can body.

7. A tear open can end comprising a panel having a first score line defining a removable panel portion, a pull tab, a rivet securing said pull tab to said removable panel portion in position to initiate rupture of said panel along said first score line, a vent score line in said removable panel portion adjacent said rivet and in a position to provide for initial rupture of said panel along said vent score line prior to initial rupture of said panel along said first score line, and a baffle plate of impermeable material attached to an underside of said removable panel portion, said baffle plate lying wholly within the confines of said removable panel portion for removal as a unit therewith and underlying said vent score line to prevent material flow out through said vent score line.

8. The tear open can end of claim 7 wherein said baffle plate is attached to said removable panel portion at spaced points only wherein said removable panel portion may be ruptured along said vent score line while said baffle plate remains impermeable.

9. The tear open can end of claim 7 wherein said can end is seamed to an end portion of a can body, said can body has an inwardly directed protective bead underlying said first score line, and said baffle plate being disposed wholly within the outline of the interior of said bead.

10. A tear open can end according to claim 7 wherein the diaphragm is aluminium foil.

* * * * *